US006167648B1

(12) United States Patent
Dimmick

(10) Patent No.: US 6,167,648 B1
(45) Date of Patent: Jan. 2, 2001

(54) ILLUMINATED MODULAR SIGN HAVING ADJUSTABLE QUICK RELEASE MODULES

(76) Inventor: Frederick Dimmick, P.O. Box 208, Parry Sound, Ontario (CA), P2A 2X3

( * ) Notice: Under 35 U.S.C. 154(b), the term of this patent shall be extended for 0 days.

(21) Appl. No.: 09/241,393

(22) Filed: Feb. 2, 1999

(30) Foreign Application Priority Data

Feb. 23, 1998 (CA) ..... 2230173

(51) Int. Cl.[7] ..... G09F 13/04

(52) U.S. Cl. ..... 40/564; 40/570; 40/572; 313/51; 362/812

(58) Field of Search ..... 40/564, 570, 572, 40/580; 362/812; 313/49, 51

(56) References Cited

U.S. PATENT DOCUMENTS 1,761,120 * 6/1930 Graham et al. ..... 40/452
2,519,302 * 8/1950 Weincord ..... 313/49 X
3,309,806 * 3/1967 Gallagher ..... 40/570
3,783,542 * 1/1974 Johnson ..... 40/564 X
5,459,955 * 10/1995 Ruskouski et al. ..... 40/564 X
5,697,175 * 12/1997 Schwartz ..... 40/570 X
5,722,760 * 3/1998 Chien ..... 40/552 X
6,042,248 * 3/2000 Hannah et al. ..... 40/551 X

* cited by examiner

*Primary Examiner*—Brian K. Green
(74) *Attorney, Agent, or Firm*—Ridout & Maybee

(57) ABSTRACT

An illuminatable sign includes a number of lighting modules arranged on an electrical circuit such that they are individually disconnectable, removable and adjustable in position between conductors. Preferably the lighting modules are slidable on the conductors while remaining in electrical contact to provide illumination where it is specifically required. Connections between the modules and the conductors may be such that the modules slide on the conductors. Such connectors may be snap on connectors or may be prongs insertable into helical springs about the conductors such that compression of the springs increases the diameter of the springs to allow them to slide on the conductors and lack of compression allows the springs to grip the prongs tightly.

4 Claims, 12 Drawing Sheets

ILLUMINATED MODULAR SIGN HAVING ADJUSTABLE QUICK RELEASE MODULES

BACKGROUND OF THE INVENTION

1. Field of the Invention

This invention relates to the illumination of signs which display a message or pattern.

2. Acknowledgement of prior art

In Canadian Patent No. 1,310,186 issued Nov. 17, 1992 to Frederick Dimmick (who is also the inventor of the invention of the present application), there was disclosed and claimed a sign comprising at least one light pipe carrying at least on light emitting diode contained in one end and directed towards another end of the light pipe. The invention disclosed and claimed in Canadian Patent No. 1,310,186 was intended to overcome many of the problems and disadvantages of the prior art. For example, the sign of Canadian Patent No. 1,310,186, comprising LEDs embedded in light pipes may reduce the maintenance and operating costs of signs in comparison with those of signs lit by incandescent or fluorescent or other light sources.

At the time that the invention of Canadian Patent No. 1,310,186 was made, it was only possible to produce LEDs of relatively restricted illuminating power. At that time, for practical purposes, the maximum illumination obtainable from the LED was in the order of 300 millicandela. Due to this limitation, the light pipes of Canadian Patent No. 1,310,186 could only be produced in short lengths if they were to provide bright illumination. For this reason, the invention was ideally suited to signs involving lettering, a separate light pipe being provided for each component of each letter. While this provides advantages if the LED in one light pipe fails, it is probable that the sign will still be readable, it does make the short light pipe lower power LED system of Canadian Patent No. 1,310,186 less suitable for signs where full background lighting is required.

Full background lighting may be desirable in some or all of the following circumstances:

1. For signs of which the front screen may be interchangeable to vary the message given. For example, such a sign might indicate store specials which vary from week to week.
2. Signs having non-standard planar shape or signs having three-dimensional shape. Such signs have presented problems in uniform lighting when utilizing rigid straight lighting pipes spaced apart in parallel relationship.
3. When variably coloured lighting and other attention getting means such as flashing or varying illumination intensity of specific colours or areas of the sign is required from one part of the sign to another independent of any lettering or indicia on the sign. In this case, the signs may be conventional rectangular planar signs or they may be planar signs of other shapes or three-dimensional signs.

The use of neon or fluorescent or incandescent bulbs is commonly used to overcome some of the problems. However, neon and fluorescent tubes must be manufactured into any unconventional shape and, should the tube fail, the whole sign may be extinguished. Incandescent bulbs utilize large amounts of electricity and take up an appreciable amount of space. Moreover, they produce heat which may be undesirable in many circumstances.

The present inventor has addressed the problems and, in particular, has addressed the problem of making the lighting system of Canadian Patent No. 1,310,186 utilizing LEDs more suitable for a wider variety of signs especially those requiring generalized background light. Moreover, the inventor has tried to provide signs which require little thickness or depth from front to back and so may be suitable for positions where physical projection is undesirable and where sign of very low weight may be required or desired. Also the inventor has tried to provide a sign which the parts, particularly the light parts are quickly and easily adjustable in position, and removable and interchangeable.

SUMMARY OF THE INVENTION

According to the invention there is provided an illuminatable sign comprising a front screen having translucent portions defining sign indicia; a back panel spaced from the front screen by at least one spacer; light modules arranged adjustably and removably between the screen and the back panel to provide illumination through said translucent portions; and means to connect said modules to a source of electrical power in such a manner that they are individually disconnectable and removable from said source and/or adjustable in position between said screen and said back panel. It is to be noted that, when used herein "translucent" includes "transparent".

Preferably the modules comprise elongate bars carrying light elements, the bars having an electrical connector at each end for quick connection into and release from an electric circuit for providing power to said light elements.

For example, each module may comprise an elongate printed circuit board carrying light emitting diodes, the printed circuit board having an electrical connector at each end for snap fitting into an electrical circuit for providing power to the light emitting diodes. Preferably the printed circuit boards may be snapped into position in the electrical circuit in a variety of different positions.

Conveniently the electric circuit includes a network of at least one pair of power buses and a plurality of light modules. The power buses may be conductive bars or wires having dimensions to accept quick release connection of the printed circuit board modules thereto. The conductive bars or wires may be spaced apart by the distance equal to the length of the printed circuit boards or equal to the incremental repeated length of the circuit boards pattern and snap connections or clip sockets may be provided on the printed circuit boards at each increment repeat of pattern.

The clip sockets may, for example, be open ended slots having an upstanding conductive fence. Such clip sockets themselves are believed to be novel. Alternatively the clip sockets may be any conventional open ended clip socket.

Alternatively the means to connect the modules in such a manner that they are individually disconnectable and removable from the source, may be a prong and socket connection. The socket may be a helical compression spring about a bus wire as the source of electrical power. The prong may extend from the printed circuit board and may have a rectangular section and a tamped point. The dimension of the helical spring and the prong may be such that, when the prong is pushed into the spring to abut the bus wire, the spring compresses to increase its diameter to allow passage of the prong and tightens on the prong to hold it in contact with the bus wire.

The prong may be formed from cold-rolled half-hard, 70% cooper–30% zinc so that it may be bent as desired so that each module is located at any desired angle to the bus wire.

The invention may provide simple, cost effective and lightweight illuminated signs that have many features not available in current sign fabrication, including both manual and electrical means for:

1. Programming Features—the network or web of buses and clip on modules creates a matrix which may best be described as a macro hybrid integrated circuit, permitting unlimited permutations for controlling brightness, colour changes and mixes, as well as selected area illumination, i.e. lighting only the areas of the sign face which require illumination; additionally overall or selected area flashing and sequential lighting of characters, lines of text or graphics, the illumination is by diffusion presented evenly and not pixilated as with typical LED programmable signs.
2. Thin Design—The signs may be thin from front to back because the LEDs do not require much space.
3. Energy Efficient—From 10 to 40 watts per square meter.
4. Reliability—Low maintenance when lit with LEDs.
5. Versatile—Flexible wire buses and clip on circuit board modules can accommodate virtually any shape requiring illumination.
6. Safe Low Voltage Operation—Battery or eliminator powered, because of low power required can be placed in locations where hydro is unavailable, powered by solar array and batteries.
7. Down Light—It is possible to provide a "down light" which is desirable in many locations, for example Exit signs.

One or more modules may be connected in electrical parallel between the conductive bars or wires although the physical distribution may be parallel or in other patterns. For example, the conductive bars or wires may be concentric circles and the modules may extend radially between them.

BRIEF DESCRIPTION OF THE DRAWINGS

Embodiments of the invention will now be described by way of example with reference to the drawings in which.

DETAILED DESCRIPTION OF A PREFERRED EMBODIMENT

Figure 1:
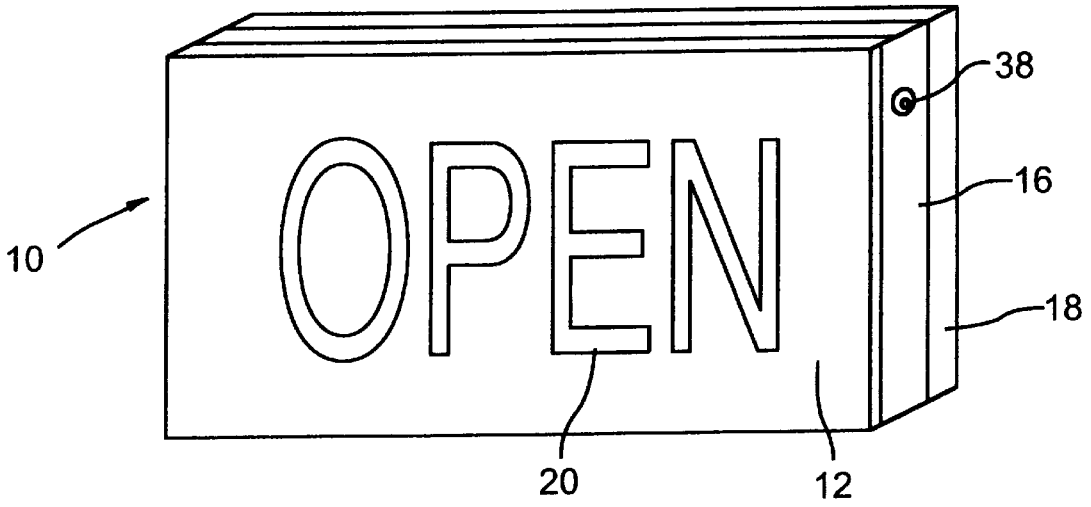
FIG. 1 is a perspective view of a sign in accordance with the invention.
Figure 2:
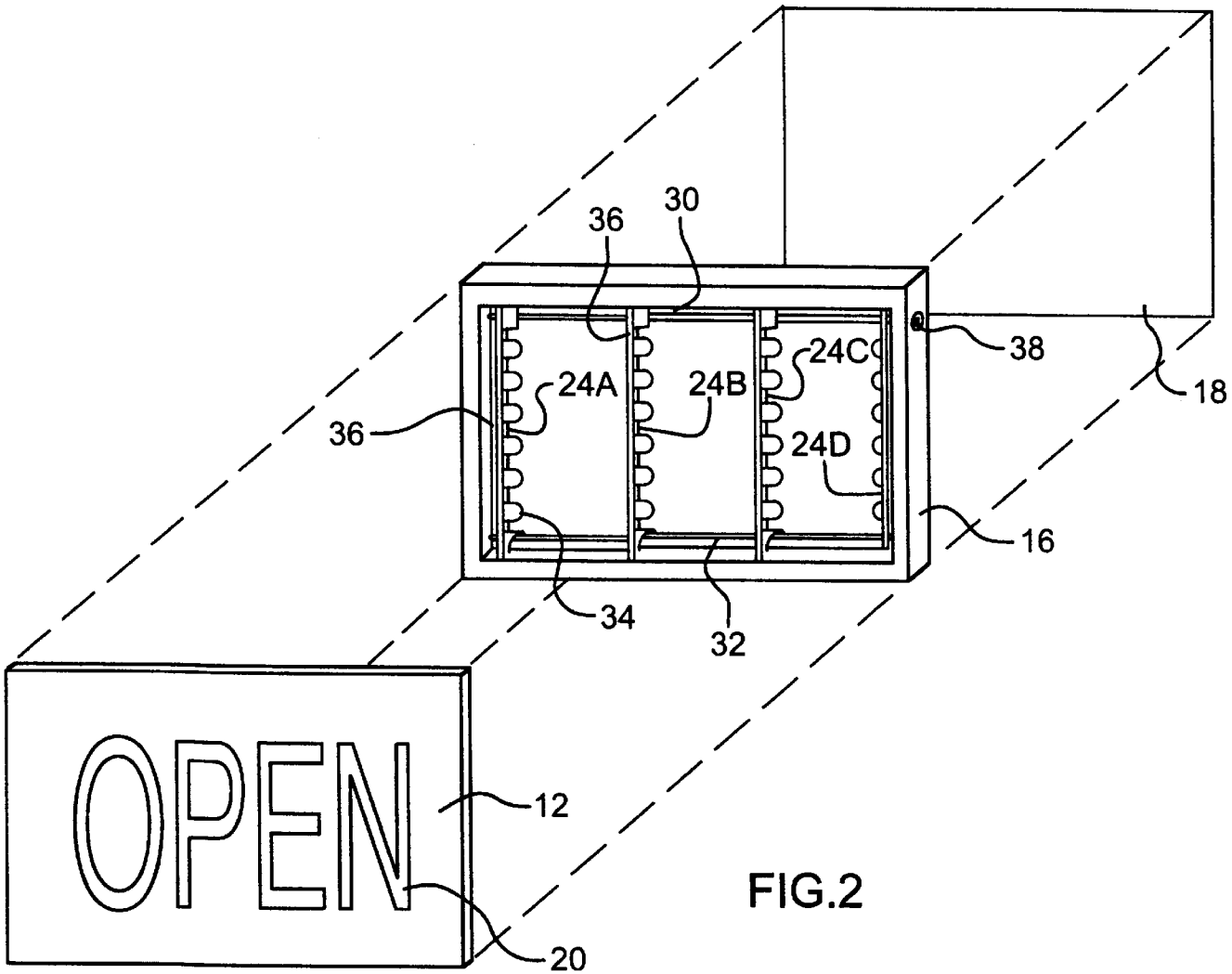
FIG. 2 is an exploded view of the sign of FIG. 1.

FIGS. 1 and 2 show a sign 10 having a front screen 12, a frame 16 and a back panel 18. Back panel 18 may be an opaque panel or a second screen (and, optionally back panel 18).

The front screen 12 has a translucent portion 20 through which light can shine. The translucent portion 20 may be an aperture or may be glazed by glass or translucent plastic material. This transparent portion 20 may be the lettering of a message or may be illustrative.

Figure 1A:
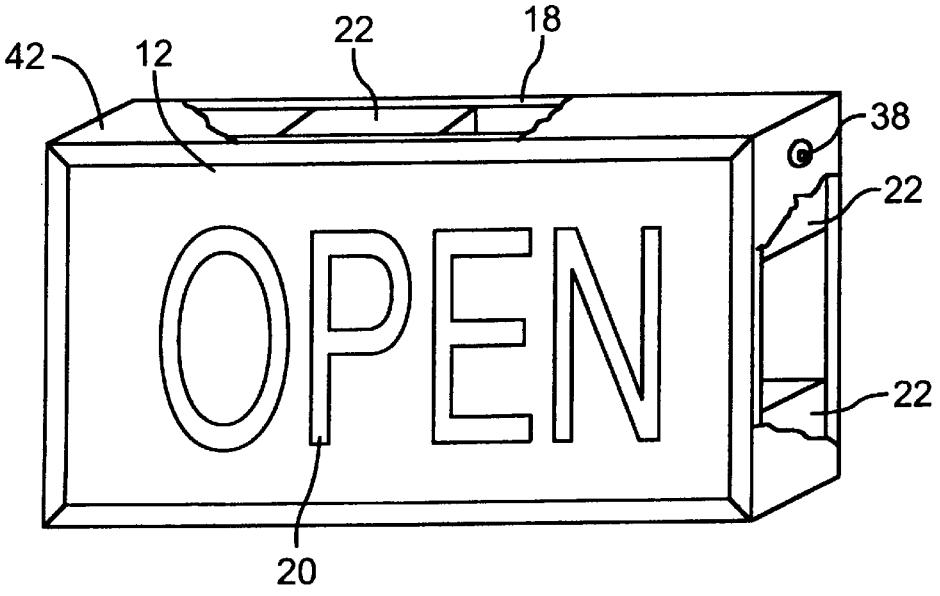
FIG. 1A is a perspective view of an alternative sign in accordance with the invention.

The screen 12 and the back panel 18 which have coextensive perimeters are connected together by frame 16 which also acts as a spacer 22 between them. It is, of course, possible to provide a frame covering the edges of screen 12 and back panel 18. In this case separate spacers 22 will be desirable. This situation is shown in FIG. 1A.

The back panel 18 carries on its front surface the circuitry necessary to provide illumination to shine through the transparent portions 20 of screen 12.

The circuitry for providing the illumination may comprise lighting modules 24 and uncovered conductive circuit wires 30, 32 spaced apart from one another. Each module comprises an array of LEDs arranged to connect one terminal of each LED to a positive terminal of the module, and the other terminal of each LED to a negative terminal of the module. The positive and negative terminals 26, 28 are respectively electrically connected to power buses, i.e. wires 30, 32 to be slidable thereon without losing electrical contact.

Figure 3:
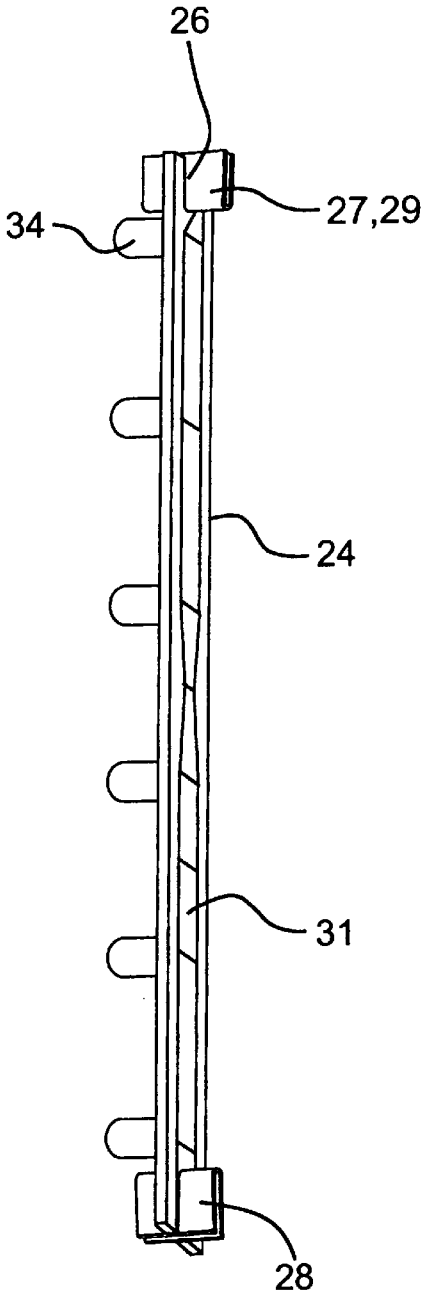
FIG. 3 is a perspective view from one side of a lighting module comprising one printed circuit board of the sign of FIGS. 1 and 2.
Figure 4:
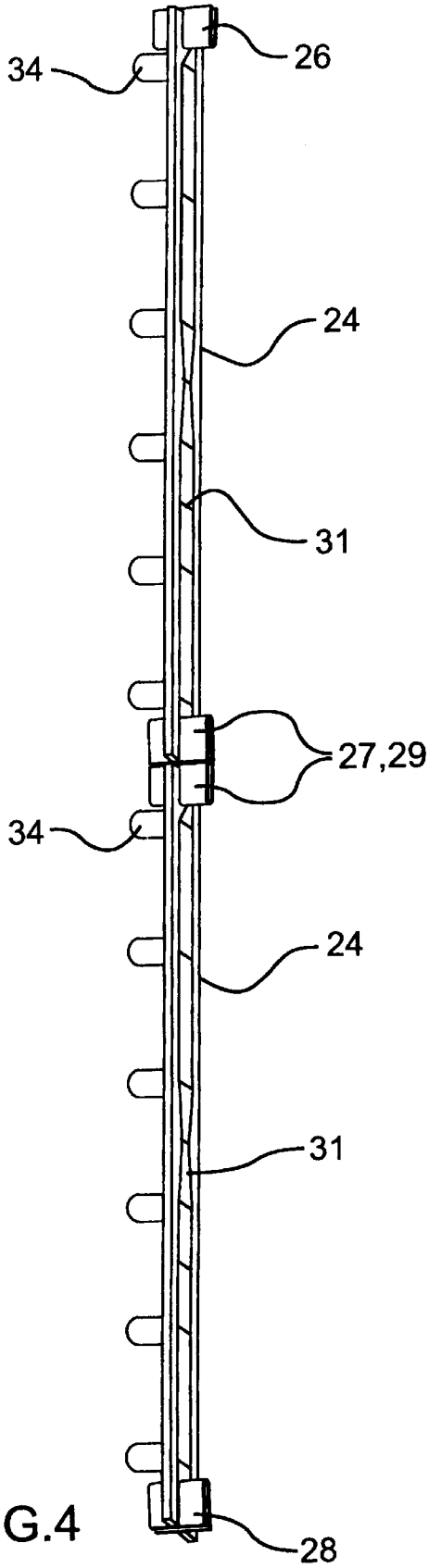
FIG. 4 is a view from a perspective view from one side of a lighting module comprising two end-to-end printed circuit boards.

As especially shown in FIGS. 3 and 4, the basic module 24 may comprise a single row of six LEDs 34 mounted on an elongate printed circuit board 36. The circuitry may be modified by placement of ballast resistors for either 6 or 12 volt DC operation. For 24 volt DC operation two end-to-end modules as shown in FIG. 4 may be used. The printed circuit board 36 is such that the first terminal of each LED series group is connected to the positive terminal 26 of the module and the other terminal of each LED series group is connected to the negative terminal 28 of the module.

The extended module of FIG. 4 shows that the circuitry may be repeated continuously on a circuit board, limited only by the ability of the circuit trace 31 connectors, and supply buses 30, 32 to carry the required current. In the circuit board industry at present, boards over 2 feet are not produced in a cost effective manner since there has been little requirement for such boards.

Boards four feet long would be preferable, as this measurement is typical in sign manufacture. Such boards may comprise eight basic, continuously connected 6 inch modules, complete with LED lamps and friction clips. Thus the board is provided in convenient increments to accommodate virtually any size requirement for illumination.

Figure 6A:
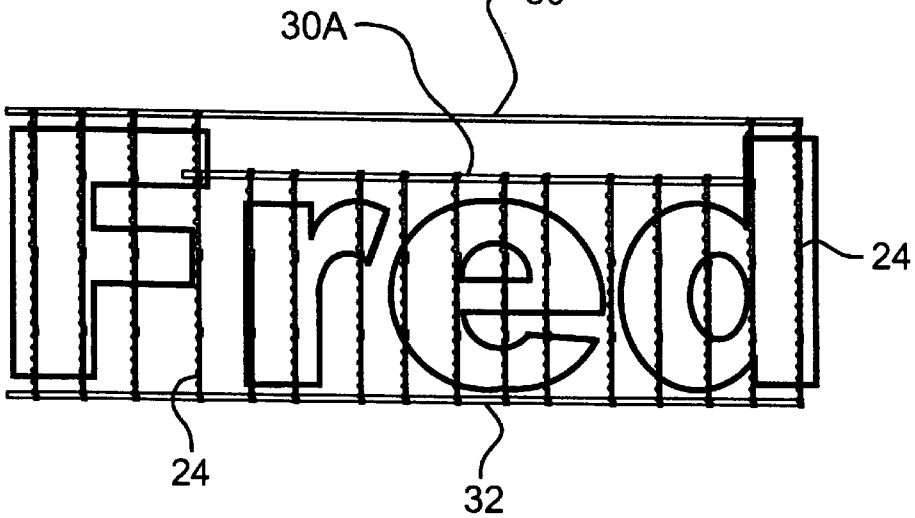
FIGS. 6A and 6B and 6C show illuminated signs indicating the positioning of lighting modules.
Figure 6B:
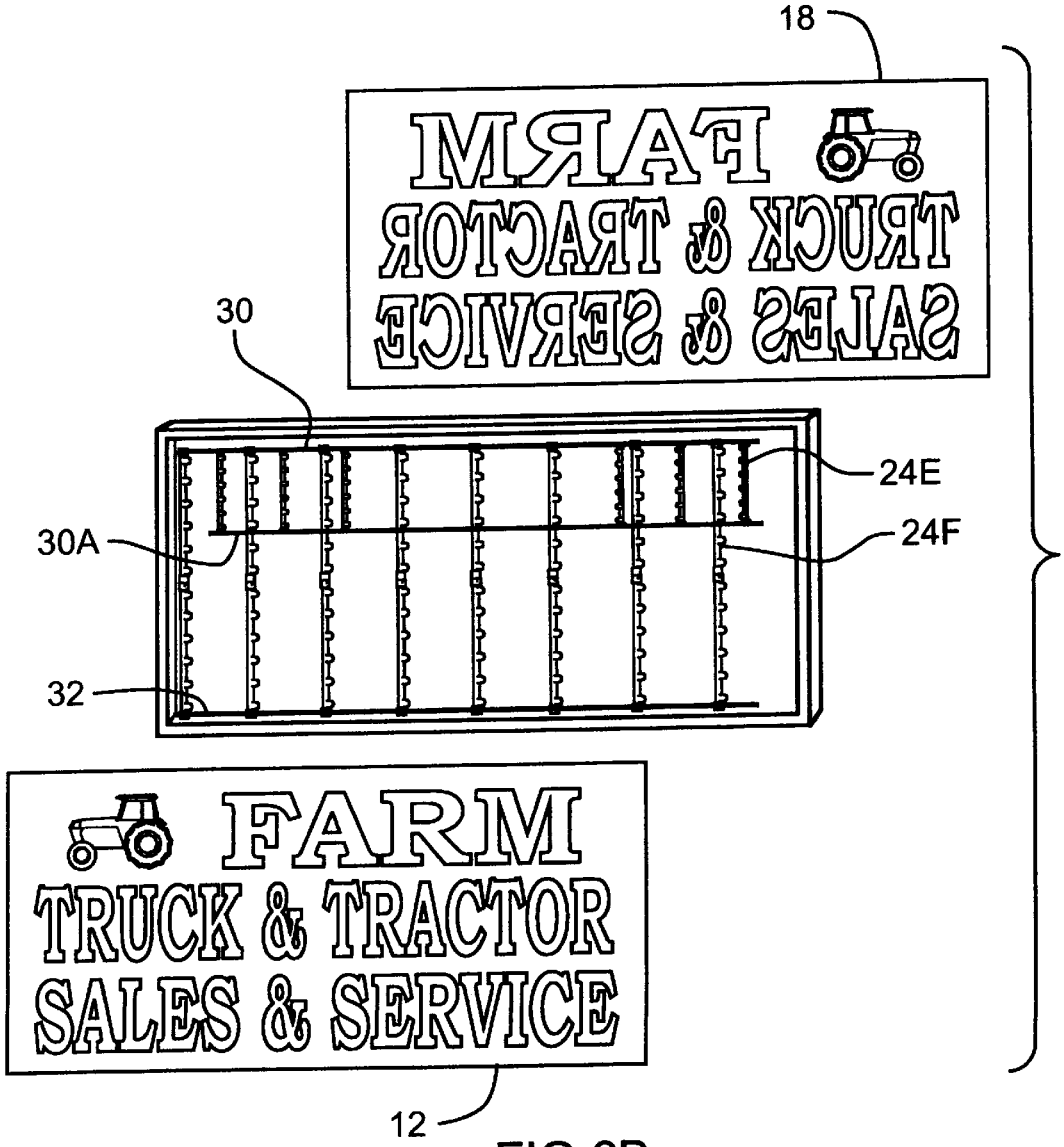
Figure 7:
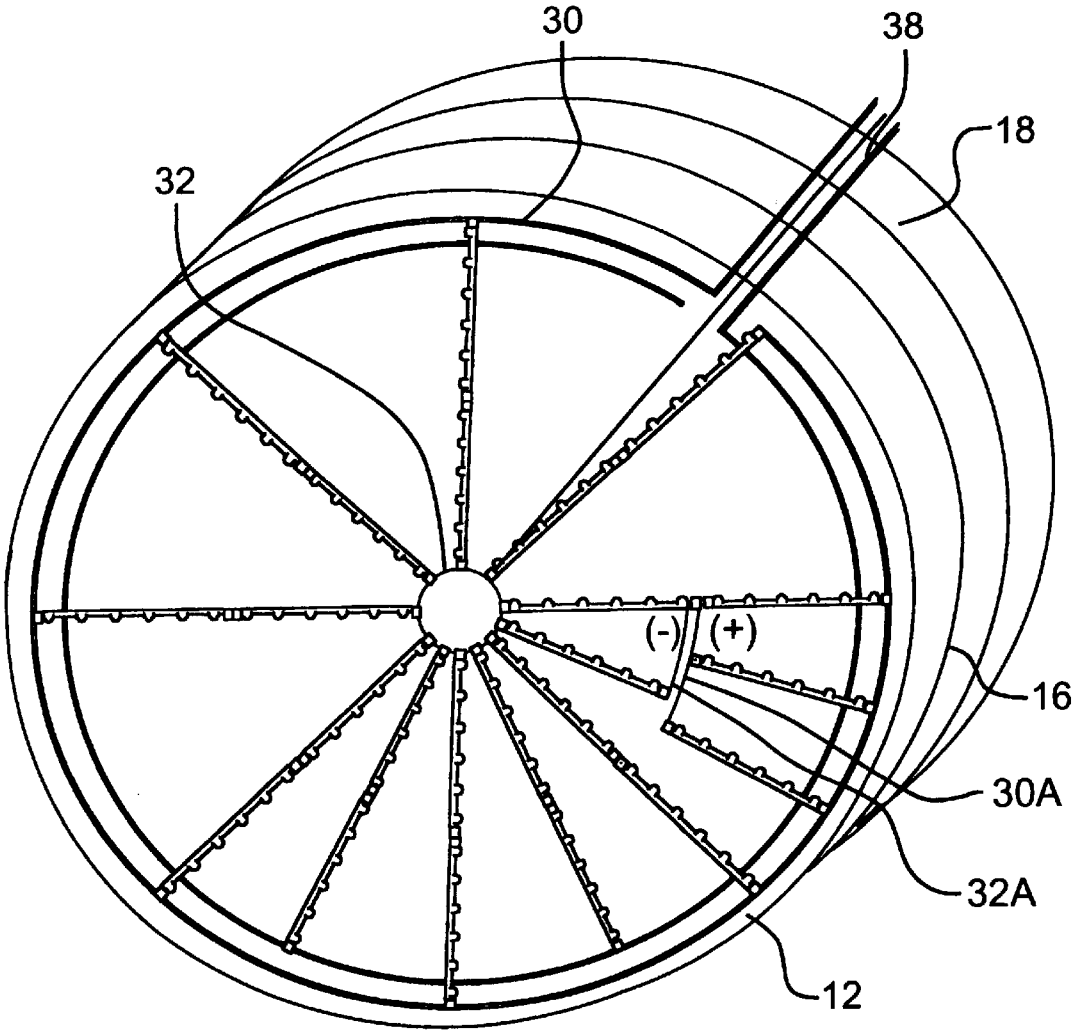
FIG. 7 illustrates module such as that illustrated in FIGS. 3 and 4 arranged for a planar curved sign.

Another advantage of boards including multiple modules is that the intermediate clips provide taps for power supply to inserted shorter boards for increased intensity or addition of colour to selected area (see FIG. 7). Such increased intensity or addition of colour may illuminate varying size graphics. Also longer boards maybe used for upper case letters and short boards may be used for lower case letters (see FIGS. 6A and 6B).

Figure 5:
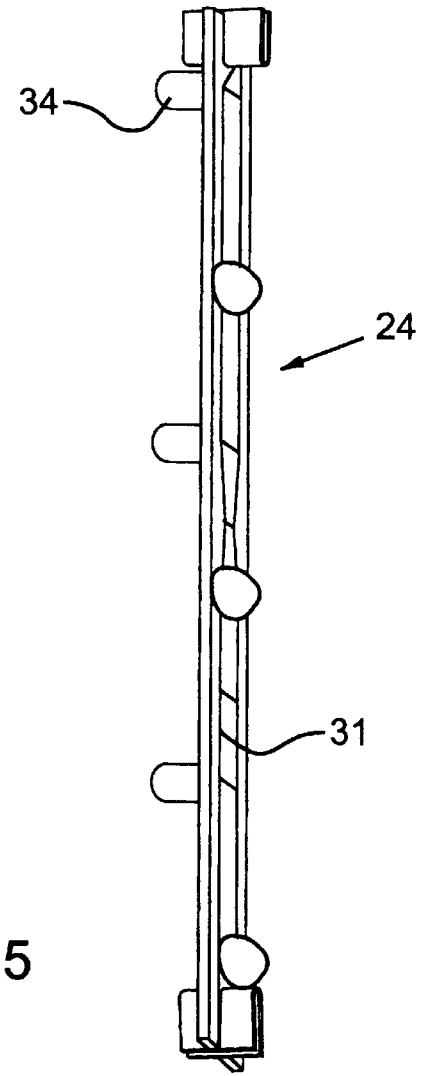
FIG. 5 is a view of an alternative module.

It is, of course, clear that each module may have other configurations, for example, that shown in FIG. 5 or more complex configurations.

Figure 9A:
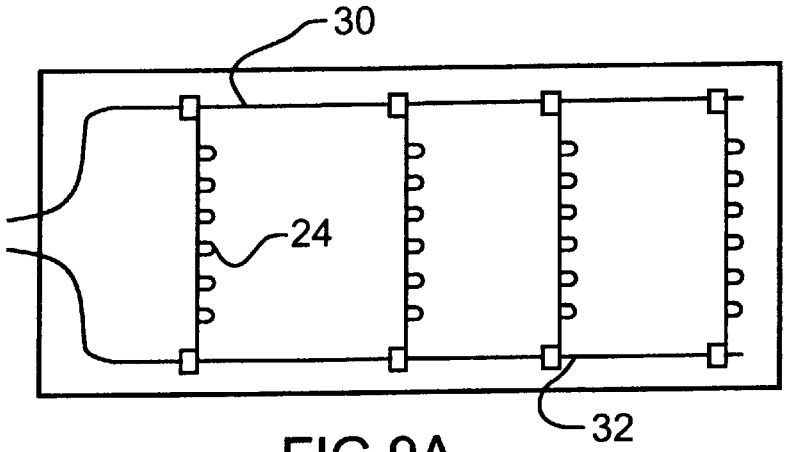
FIGS. 9A, 9B and 9C are sketches showing the progression in adjusting the position of lighting modules such as that shown in FIGS. 3 and 4 and interchanging a module for another.
Figure 9B:
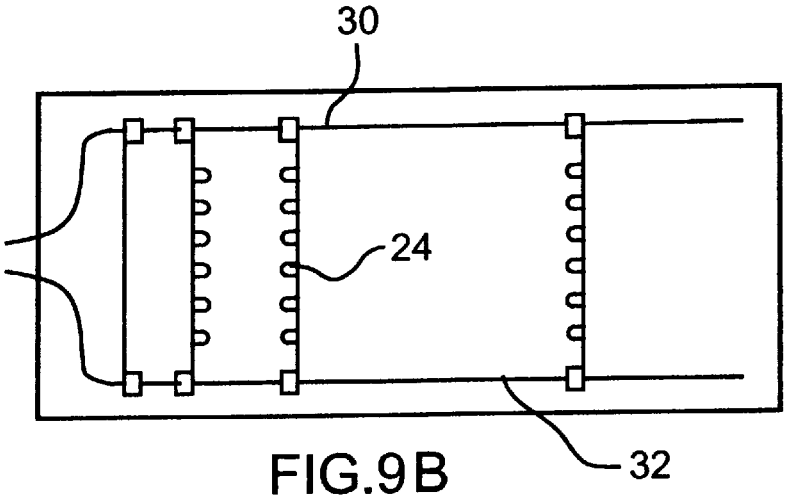
Figure 9C:
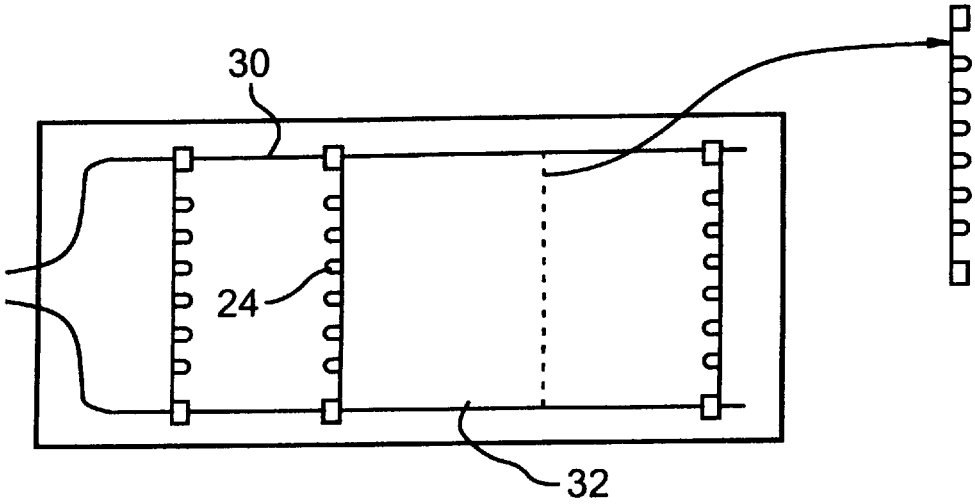

Conveniently, each novel terminal 26, 28 comprises a conductive, open ended slot having respective conductive fences 27, 29 to frictionally engage wires 30, 32. Thus, it is possible to adjust the position of module 24 on wires 30, 32 by sliding the module along the wire. It is also possible to remove module 24 from wires 30, 32 by disengaging the wire from the clip slot 26, 28. The module may then be replaced by an alternative module offering a different colour of LEDs or to replace a failed module. The sequence of events in adjusting the position of or changing a module is best seen in FIGS. 9A, 9B and 9C and will be described hereinafter.

Input wire terminals 30, 32 may be connected to an AC power source through a bridge rectifier capacitor and voltage regulator to provide a DC power source of, for example, 12 volts. However, one possible advantage of the present system is that it may be run from an AC source using a standard AC to DC adaptor. Flashing circuitry may be interposed between the DC power source and all or selected portions or sign electrical distribution system to attract attention or to significantly reduce power consumption while operating in a continuous mode or in conjunction with sensing devices to enable the sign only when traffic is present to observe the message. If the sign is to be used in a region where the electricity supply is unreliable or unavailable, it may be powered directly from a 12 volt battery, for example, in automotive and marine vehicles in which it may be powered from an internal 12 volt power point.

To provide background illumination which is generally regular over the area of the sign the illuminating power of the LEDs and their spacing apart on each module is carefully chosen. Moreover, the number of modules and their pattern and spacing is also important.

For a rectangular sign 10 as shown in FIGS. 1 and 2 having a dimension of 16 inches by 96 inches, it may be suitable to use 4 modules 24 each comprising a single row of LEDs on an elongate circuit board 36, the LEDs 34 each having a power of 8–9 candela and spaced apart by say 3 inches along the length of the circuit board 36. Such a sign may have a total wattage of 14 watts.

FIGS. 6A and 6B show examples of layouts for the lighting modules. FIG. 6A shows a combination of long and short boards for different areas of the sign. FIG. 6B is an example of a two sided sign in which, not only front screen 12, but also back panel 18, has translucent portions. The text may be one colour and the graphics may be two colours. The graphic outlines are the same colour as the text provided by the longer modules 24F. The body of the graphic is second colour, the short modules 24E provide the second colour and they share the same electrical feed as the balance of the modules but have a separate return bus which can be used to enable independent flashing of the graphic logo.

Figure 6C:
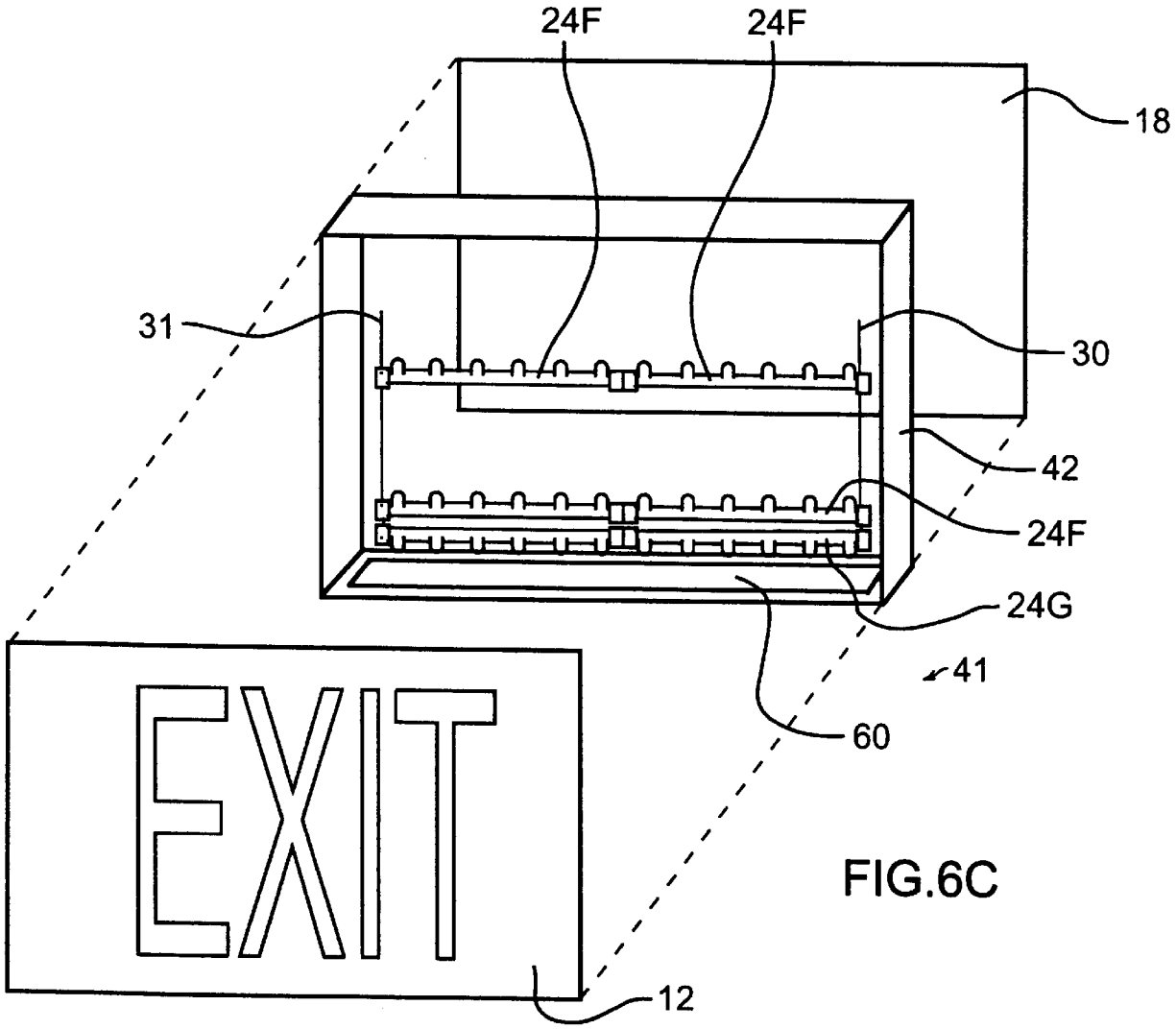

FIG. 6C shows an Exit light having a down light. The front screen is lit by modules 24G which might, for example, show red light. It also has a downwardly directed light which shows through an aperture 60 in a floor 41 of frame 42. The downwardly directed light from modules 24H might be orange/amber.

The angle of dispersion of the illumination from each LED may advantageously be in the region of 23° for the exemplary sign referred to above. It is clear, however, that the choice of the angle of dispersion for each LED 34, the illuminating power of each LED 34 and their spacing apart on the module and the number and pattern of the modules 24 is a matter of choice dependent upon the background lighting required for the sign. The colour, or colour variation across the sign may also be a matter of choice depending on the colour of LEDs chosen for each module and the pattern and spacing of the modules.

Again, for the exemplary sign shown in FIGS. 1 and 2, the modules may be arranged in a pattern and spacing shown, i.e. parallel to each other and to the sides of screen 12 and back panel 18. Thus the two outermost modules 24A and 24D may be arranged with their circuit boards 36 aligned with side edges of screen 12, the planes of the circuit boards being at right angles to that of screen 12 and the light from LEDs 34 being directed inwardly across the screen 12 and back panel 18. Inner modules 24B and 24C may be parallel to modules 24A and 24B and the LEDs 34 on those modules 24B and 24C may be directed across the sign in either direction. For most purposes it is not desirable to place modules 24B and 24C with the backs of their circuit boards 36 close together with their LEDs 34 directed towards the sides of the sign. This may make an undesirable shadow down the centre of the sign. For regular background light it may be desirable to space the modules 24 evenly. For very regular distribution of light in the sign it may be that the inner modules such as 24B and 24C have LEDs 34 directed to both sides of the printed circuit board. In this case the printed circuit will be partially on one side of the board and partially on the other side of the board. Such a bi-directional module is shown in FIG. 5.

The modules 24 may be mounted on back panel 18 by means of the power buses 30, 32 which may be provided in the form of strong wires between side members 14 of the frame 16. Wire 30 stretches between side members 14 near the top of the frame 16 and wire 32 stretches between members 14 near the bottom of the frame 16. Modules 24 are provided with connectors for wires 30, 32 comprising conductive open ended slots having respective fences 27, 29 forming friction clips at each end of the elongate printed circuit board 36, and intermediate clips in the slots at the regularly repeated intervals along the board. These clips 27, 29 attach respectively to wires 30, 32 to form a good electrical connection therewith. Each module 24 may be independently clipped into place on the wires 30, 32 and may be adjusted along the length of the wires once in position, or branched from adjacent modules with additional wires 30A, 32A. An alternative form of connection for the modules is to provide a tubular socket through each end. Wires 30, 32 are threaded through the sockets Such modules having tubular sockets may be adjusted along the length of the wires 30, 32 but can not be removed from them unless a free end of wire is made available so that the modules 24 may be unthreaded therefrom.

For simplicity, the spacers may be formed integral with the frame as a structural spacing frame 16 between the screen 12 and the back panel 18. This is best shown in FIG. 2. The back panel 18 may be secured to the frame 16 by screws or other means and the screen 12 may be releasably attached to the frame 16 by hook and loop fastenings such as Velcro (Registered trademark) or other releasable fastening means so that it may be easily removed and replaced with a different screen when desired. The wires 30, 32 extend through the sides of the frame to terminate one end in an insulated fixing 40 and, at the other end, in a socket 38 for an AC to DC 12 volt adaptor. The frame 16 is conveniently made of rigid plastic material such as PVC which provides some insulation for wires 30, 32.

When frame 16 acts as a spacer between the screen 12 and back panel 18 as just described, it may be preferable to provide a light over-frame 42 enclosing the edges of screen 12 back panel 18 and frame 16. This is particularly useful when the sign is to be located out of doors to prevent water ingress. Even when the sign is to be located indoors, such an over-frame 42 may provide an aesthetic appearance.

The arrangement of elongate modules 24 so far described, such modules being adjustable on conducting wires 30, 32 is of particular benefit where non-rectangular signs are to be provided.

FIG. 7 shows a circular sign in which wire 30 extends around the inner perimeter of the sign 10 inside frame 16 and wire 32 forms a small circle near the centre of the sign. Modules 24 similar to the elongate modules already described are arranged radially between wires 30, 32. The positioning of the modules on the wires is adjustable for fine tuning of the illumination by sliding the modules on the wires as previously described. Moreover, if the modules are provided with clip slots 40, the modules may be interchanged or replaced as desired by clipping them on and off wires 30, 32. FIG. 7 also shows power buses 30A, 32A to provide increased illumination of modules 24H.

Figure 8:
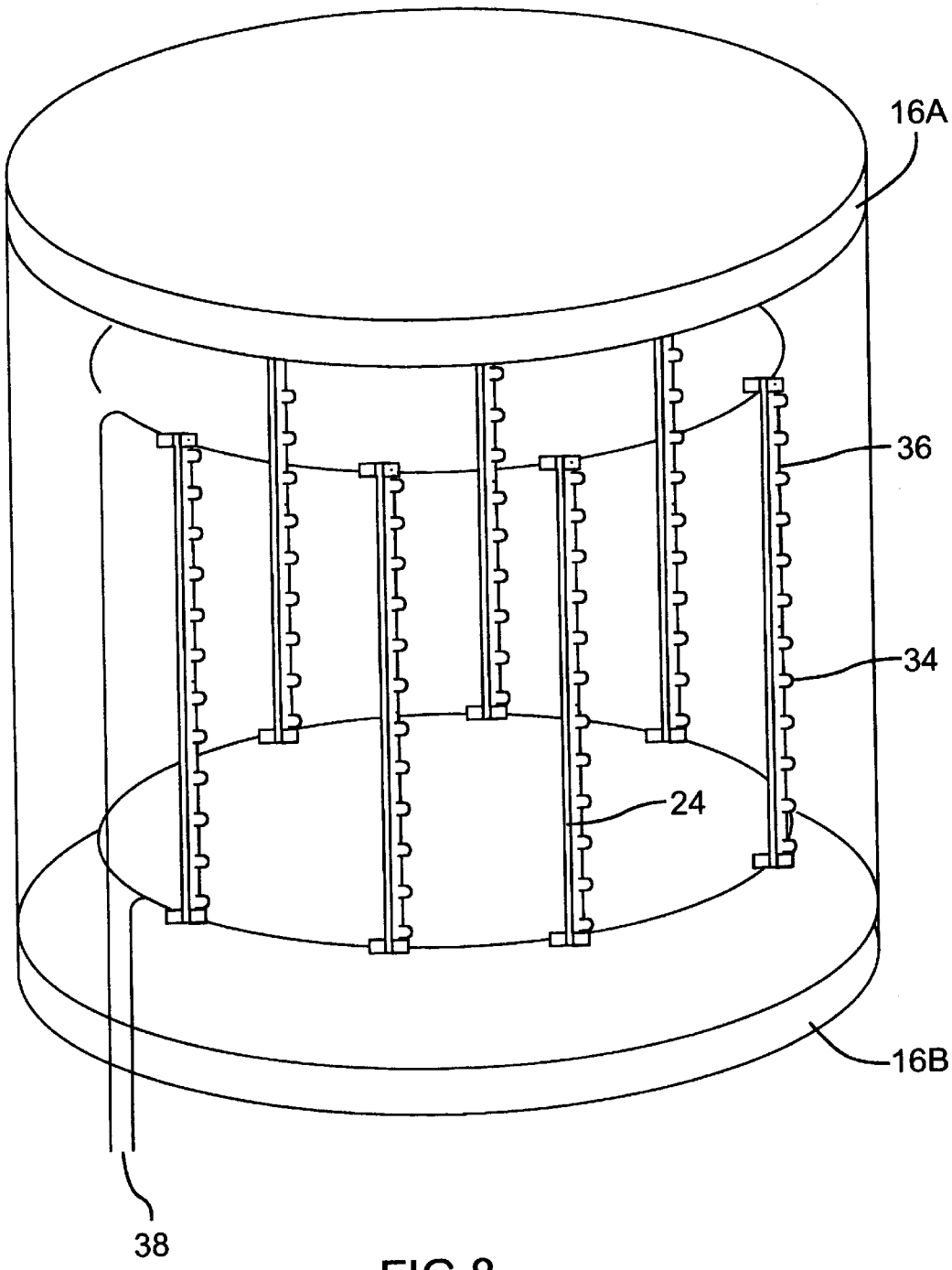
FIG. 8 shows lighting modules such as that illustrated in FIGS. 3 and 4 arranged for a three-dimensional cylindrical sign.

FIG. 8 shows a cylindrical sign in which wire 30 extends around one end of the cylinder and wire 32 extends around the other end of the cylinder. Elongate modules 24 extend between the wires around the outside of the cylinder. In this case, the frame 16 comprises a component 16A at one end and another component 16B at the other end. The screen 12 is cylindrical and may be slid over circular component 16A, 16B to be held in either a force fit or by releasable attachment such as Velcro. To provide a convenient connecting socket for an AC/DC adaptor, a connecting wire may be led from end of the cylinder to the other from wire 32 to the end of the cylinder adjacent wire 30. It is then convenient to provide a socket in component 16A adjacent wire 30.

The modules, each comprising LEDs in series are themselves connected in parallel in an electrical circuit powered from the AC supply and including a bridge rectifier capacitor and voltage regulator 44 to provide direct current across the LEDs. The rectifier/regulator may be located inside the frame on a printed circuit adjacent the inside frame edge. In this case the socket 38 for an AC/DC 12 volt adaptor may be replaced by a two or three pin conventional socket for AC supply.

When it is desired to change a module or adjust its position the sequence of events may be explained with reference to FIGS. 9A, 9B, and 9C.

FIG. 9A shows a rectangular sign having four elongate modules 24 arranged spaced apart in equal intervals across the sign from one side to the other.

For example let us suppose that it is desired to provide greater illumination at one side of the sign than at the other. Then the screen 12 (not shown in FIGS. 9A, 9B and 9C for simplicity) is removed and the modules are slid for example, into the position shown in FIG. 9B.

If a module 24 fails (or if a different colour is desired), the appropriate module is removed simply by pulling it forwardly in the direction of the arrow shown in FIG. 9C to disengage clips 27, 29 from wires 30, 32. The offending module may then simply be lifted away and another may be put in its place.

It will be appreciated that the use of LEDs as lighting units mounted on elongate narrow printed circuit boards may allow for minimum space between screen 12 and back panel 18. This may permit the construction of a sign which is very thin from front to back. Such a sign may appear to be almost completely flush with a wall to which it is mounted. Nevertheless, it is to be commented that the invention is not limited to the use of LEDs and printed circuit boards. It is quite possible that the modules may be lighting bars utilizing incandescent or fluorescent units provided that such modules are provided with terminals which will snap fit onto carrier conductive bars or wires to be slidable thereon without loss of electric contact so that a sign having adjustable interchangeable parts is provided.

Figure 10:
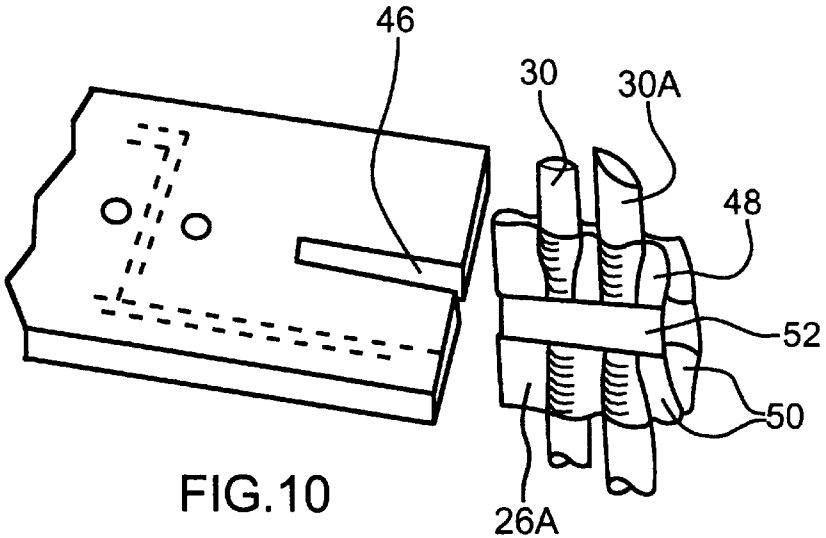
FIG. 10 shows an enlarged view of a novel means for attaching modules to the power buses.

FIG. 10 shows an end of a printed circuit board 36 having a slot 46 in one end and a novel conductive open ended clip 26A at one end. The clip 26A has two gullets 48 for holding bus wires 30, 30A with flared lips 50 at front edge to ease onto wires 30 or 30A, a broad channel 52 in the centre to fit snugly into circuit board slot 46 with sides tapered to top and bottom edges to provide spring grip of wire buses 30, 30A.

Figure 11C:
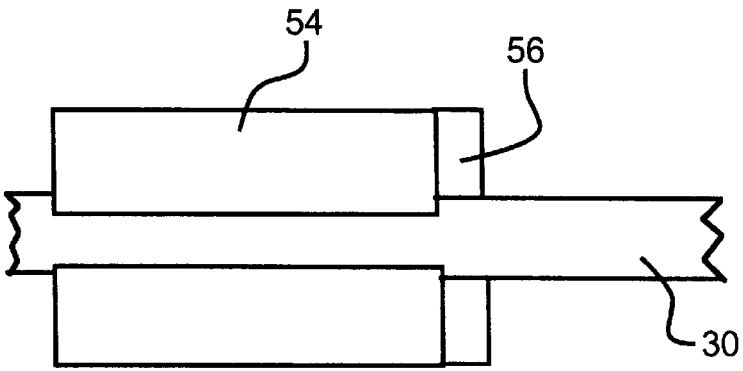
FIGS. 11A, 11B and 11C show an embodiment of another clip.
Figure 11A:
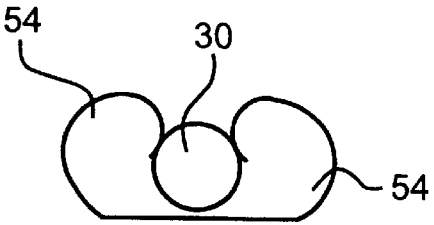
Figure 11B:
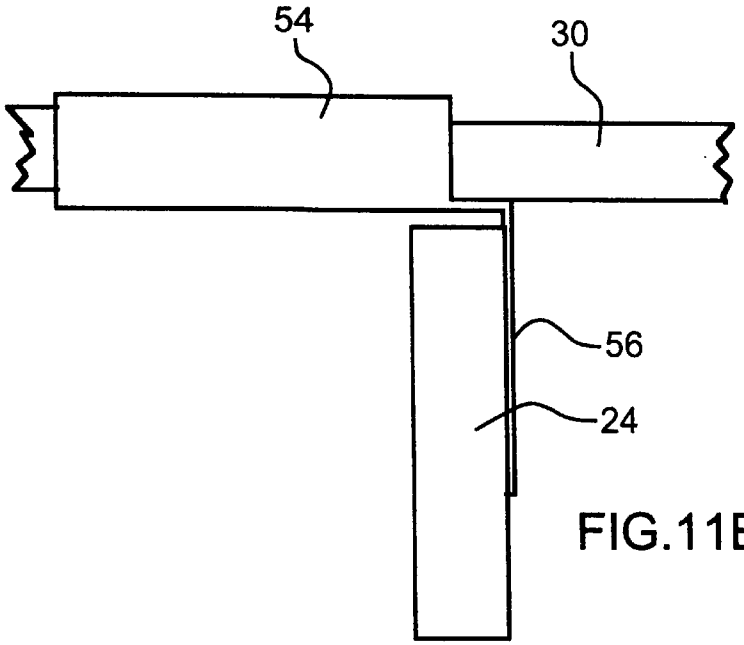

FIGS. 11A, 11B and 11C show an alternative embodiment of a clip 26B. Clip 26B comprises a pair of curved conductive straps 54 biased towards each other as shown in FIG. 11A and extending upwardly from extending tongue 56. A possible advantage of the clip 26B is that it may be positioned in locations according to choice with respect to lighting module 24 (see FIG. 11B). Tongue 56 may be bent a right angles as shown to make contact with the printed circuit board 36 or may be bent at other angles.

Figure 12A:
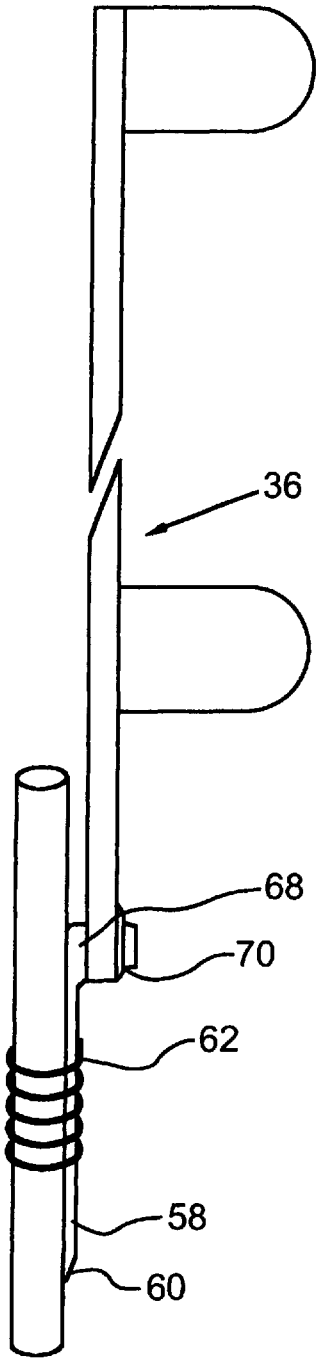
FIGS. 12A and 12B show an alternative novel means for attaching modules to power buses.
Figure 12B:
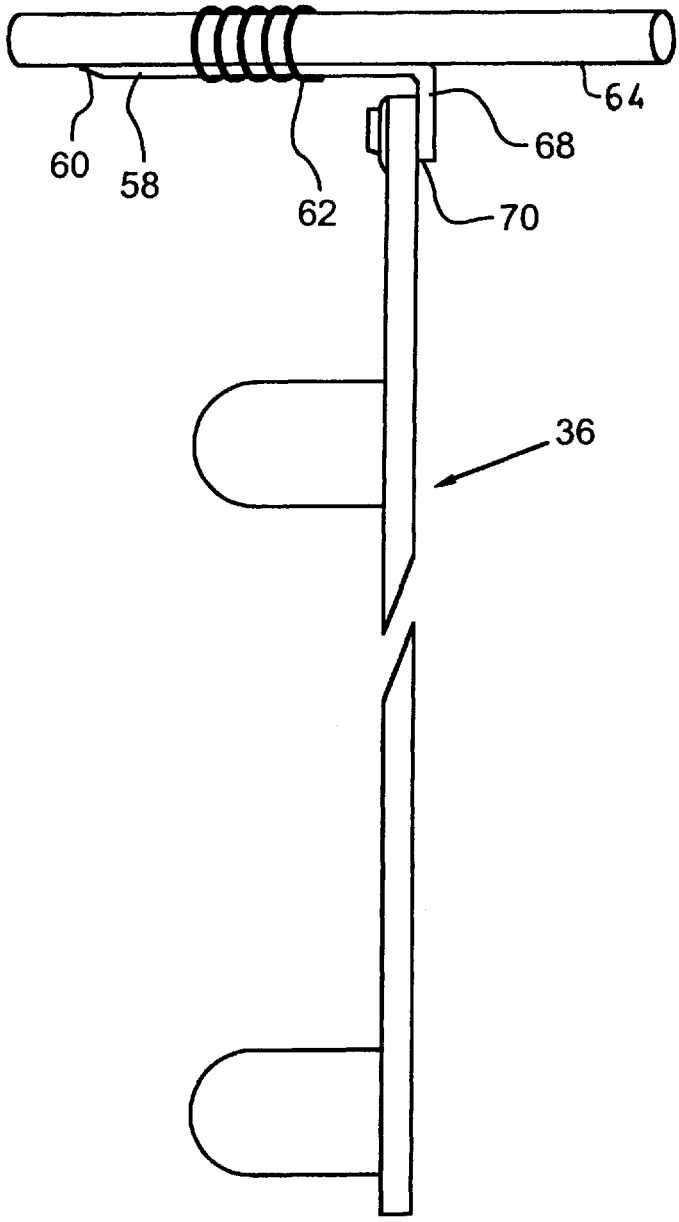

FIGS. 12A and 12B show an end of a module 36 having a prong 58 at one end. Prong 58 is of rectangular cross section and has a ramped tip 60. Prong 58 is conveniently formed of cold-rolled, half-hard, 70% copper–30% zinc. The prong 58 may be fixed to the module by a bent over end 68 through circuit board and soldered into position by means of a soldered boss 70.

A helical compression spring 62 is located about bus wire 64 which may be of tinned copper. The diameter of the uncompressed spring 62 is such that, when the tip 60 of prong 58 is pushed into it, it compresses to increase its diameter to allow passage of the prong 58 into the spring alongside bus wire 64.

The spring 62 is biassed to grip the prong 58 to hold it firmly against bus wire 64. Whenever the spring is compressed by axial pressure on the prong 58 along bus wire 64, the diameter of the spring increases to allow it to slide along bus wire 64 to adjust the position of module 36. When axial pressure on the prong 58 is relaxed the bias of the spring 62 allow it to grip the prong firmly. The grip may be sufficient to make reliable, vibration proof contact with the bus wire.

The prong 58 may be bent at the point it leaves the module 36 (see FIG. 12B) to enable the orientation of the module to be altered in relaxation to the bus wire 64. FIG. 12B shows a 900 bend which places the LEDs 34 perpendicular to the bus wire 64 rather than parallel to it as shown in FIG. 12A.

Figure 13:
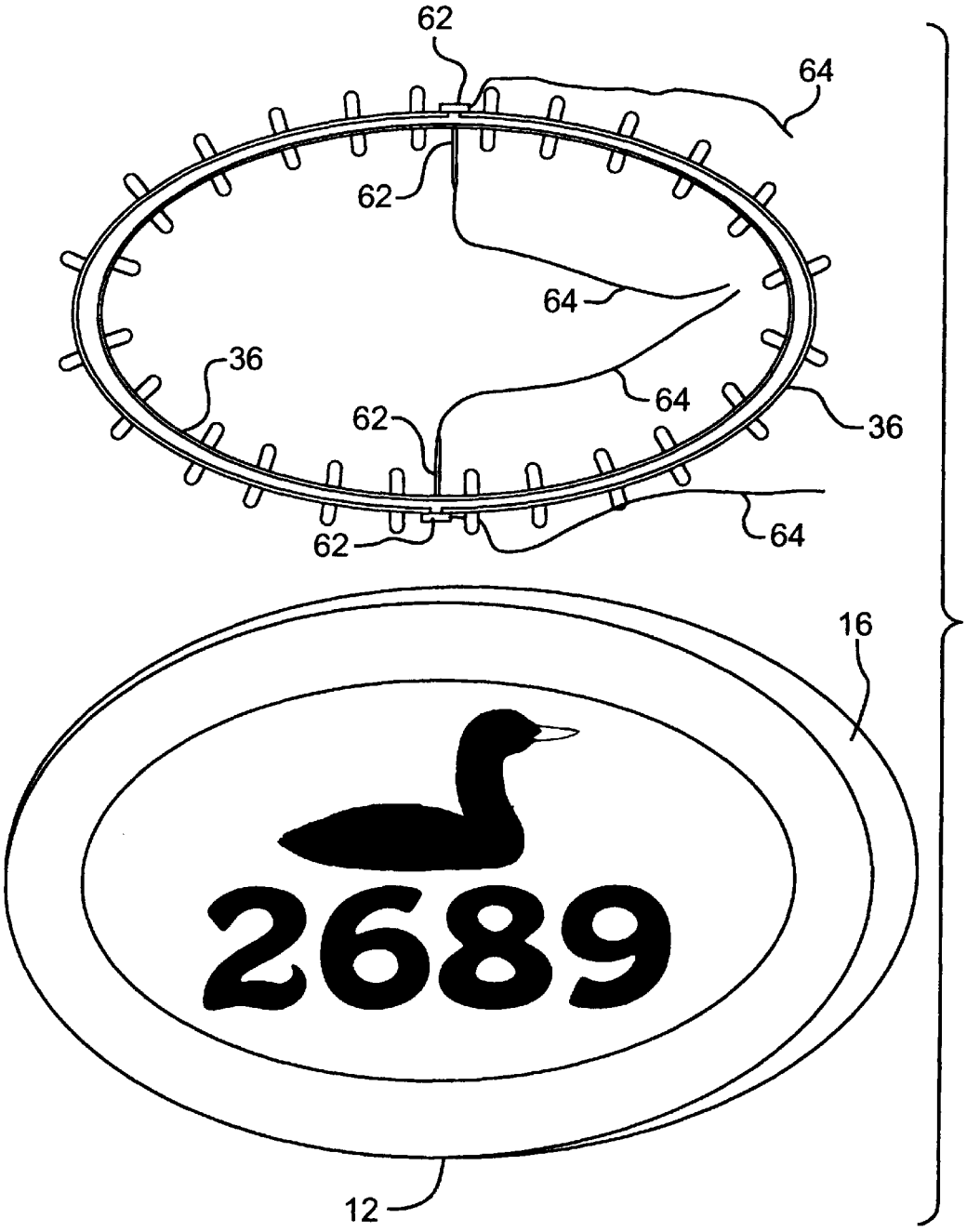
FIG. 13 shows curved modules attached to power buses by the attachment means of FIGS. 12A and 12B.

The modules 36 may be formed from glass reinforced epoxy resin and may, themselves, be bent into shapes to direct the LEDs inwardly or outwardly of the curves (see FIG. 13). Such bent circuit boards may have a prong 58 at each end for connection to bus wires. The diameter of the bus wires, the cross section of the prong 58 and the diameter of the spring 62 may be varied for optimum grip and sliding of the spring on the bus wire.

I claim:

1. An illuminatable sign for connection to a source of electrical power, the illuminatable sign comprising a front screen having translucent portions defining sign indicia;

a back panel spaced from the front screen by at least one spacer;

an electric circuit for connection to the source of electrical power, the electric circuit including a network of at least one pair of conductive buses and a plurality of light modules arranged adjustably and removably between the screen and the back panel to provide illumination through said translucent portions, each bus having a helical spring thereabout and each light module having at least one prong projecting therefrom for insertion into said helical spring whereby said helical spring grips said prong to hold it against said bus.

2. An illuminatable sign as claimed in claim 1 in which the diameter of said helical spring is such that it holds said prong in electrical contact against said bus when said prong is located within said spring and said spring is uncompressed axially and in which a diameter of the helical spring is such that it will allow passage of the prong thereinto and sliding upon the bus when compressed.

3. An illuminatable sign as claimed in claim 2 in which the modules are curved, elongate printed circuit boards.

4. An illuminatable sign as claimed in claim 1 in which said prong is bendable at a location adjacent the module to allow adjustment in angular orientation of the modules to said bus.

* * * * *